United States Patent [19]

Collier

[11] 3,978,484

[45] Aug. 31, 1976

[54] WAVEGUIDE-TUNED PHASED ARRAY ANTENNA

[76] Inventor: Donald C. Collier, 3825 SW. Sixth Place, Gainesville, Fla. 32607

[22] Filed: Feb. 12, 1975

[21] Appl. No.: 549,501

[52] U.S. Cl. ..... 343/754; 343/854

[51] Int. Cl.[2] ..... H01Q 15/00

[58] Field of Search ..... 343/753, 754, 755, 854

[56] References Cited

UNITED STATES PATENTS

| | | | |
|---|---|---|---|
| 2,343,531 | 3/1944 | Buchholz | 343/786 |
| 2,602,893 | 7/1952 | Ratliff | 343/768 |
| 2,986,734 | 5/1961 | Jones et al. | 343/854 |
| 3,274,601 | 9/1966 | Blass | 343/754 |

*Primary Examiner*—Eli Lieberman

*Attorney, Agent, or Firm*—Duckworth, Hobby, Orman, Allen and Pettis

[57] ABSTRACT

A phased array radar antenna comprises an array of hollow, rectangular tubes, each tube having an opening therethrough. A tuning slug is positioned within each of the hollow tubes, and is mechanically coupled with a transducer for moving each tuning slug through the corresponding hollow tube responsive to an electrical input thereto. A feed horn is provided for radiating electromagnetic energy into the openings of the hollow tubes whereby the energy is reflected therefrom in a direction and in a beam width determined by the position of all of the slugs.

8 Claims, 5 Drawing Figures

WAVEGUIDE-TUNED PHASED ARRAY ANTENNA

BACKGROUND OF THE INVENTION

1. Field of the Invention

The present invention relates to antennas, and in particular relates to phased array antennas useful for radar applications.

2. Description of the Prior Art

A basic analysis of phased array antenna technology is given by S. A. Schelkunoff, in the treastise Electromagnetic Waves, D. Van Nostrand Company, Inc., New York, 1943; and in an article entitled "A Mathematical Theory of Arrays" appearing in the January 1943 issue of the Bell System Technical Journal. Prior art phased array radar antennas have heretofore been used exclusively for governmental applications. There are a number of reasons for this, but primarily the failure to utiilize phased array radar antennas in civilian airport surveillance radars and on-board aircraft radars stems from cost factors.

The high cost of military phased array radar systems are traceable to the time requirements for such systems, which must be capable of intercepting and tracking ultra-high performance aircraft and missiles. Accordingly, such military systems have heretofore utilized high speed electronic components to achieve phase tuning within the individual wave guide elements, which means the acceptance of poor phase shifting paramters (for example, an incremental phase shift of 22.5 degrees is typical for state of the art military systems). To compensate for this problem, such military systems employ large numbers of wave guide elements, on the order of several thousand. As a result, by employing electronic tuning in each waveguide element, the cost for such a system goes well beyond the capabilities of a municipal airport facility; further, it is clear that such systems are quite large and are incapable of being employed on board single engined private aircraft.

A number of prior art patents disclosed various phased array radar antenna and related techniques. For example, Rearwin, in U. S. Pat. No. 2,967,301 teaches a selective directional slotted waveguide antenna. Mohr et al, in U.S. Pat. 3,736,535 teach a phase shift antenna for discriminating radar echoes from noise. This system employs ferrite shifters for providing phase shift in a circular polarization mode. U.S. Pat. No. 3,775,796 to Heeren et al suggests the use of a parasitic reflector in conjunction with an array of radiating elements smaller than the reflector, such that the shape of the reflector is utilized to determine beam width and direction. Blass, in U.S. Pat. No. 3,408,653, teaches a phased array antenna utilizing feed members spaced outside the focal plane and controlled to produce feed points within the focal plane of the impinging surface of the antenna. Various other phased array and related microwave processing techniques are disclosed in the following U.S. Pat. Nos.: 3,706,998 to Hatcher et al; 3,534,365 to Korvin et al; 3,803,619 to Meek et al; 3,404,405 to Young; 3,276,023 to Dorne et al; 2,530,580 to Lindenblad; and 3,761,943 to Harper et al.

While all of the above references disclose various techniques for solving the sophisticated problems associated with large and complex military phased array systems, this technology adds to the overall costs of such systems. Further, prior art phased array radar antennas require specially designed electronic systems which cannot be suitably employed with conventional radar antennas, and vice versa.

SUMMARY OF THE INVENTION

The present invention contemplates a phased array radar antenna comprising an array of hollow waveguide elements, each having an opening therethrough. A plurality of tuning slugs is provided, each tuning slug being positioned within one of the hollow elements. Means are provided for moving each tuning slug through the corresponding one of the hollow elements, and further means are provided for radiating electromagnetic energy into the hollow elements whereby the energy is reflected therefrom in a direction determined by the position of the tuning slugs.

Another important aspect of a phased array antenna in accordance with the present invention is the utilization of a feed horn disposed at an angle, for example 45°, with respect to the axis of the hollow elements, such that the feed horn does not create a "blind spot" and thereby reduce the overall efficiency of the array of hollow member waveguide elements.

Another important aspect of the system of the present invention is the ability of the system to contour the relative positions of all of the tuning slugs in an array of elements so as to achieve a non-linear alignment thereof in order to control the width of the radiated beam, and to some extent, control the direction of the beam.

The present invention was developed in partial fulfillment for academic requirements. A reduction to practice and experimental analysis of the phased array antenna system of the present invention is disclosed in a thesis entitled "Study of an Experimental Phased Array Radar Antenna" first deposited at the University of Florida in December, 1974. The text of this study is incorporated in this specification by reference thereto.

The Drawings

FIG. 1 is a perspective view, partially cut away, of a phased array radar antenna system in accordance with the present invention.

FIG. 2, which is partially in perspective and partially in block diagram form, illustrates a respresentative waveguide element in accordance with the present invention and the circuitry associated therewith.

Detailed Description

A preferred embodiment of a phased array radar antenna system in accordance with the present invention will be described with references to FIGS. 1 and 2.

Figure 1:
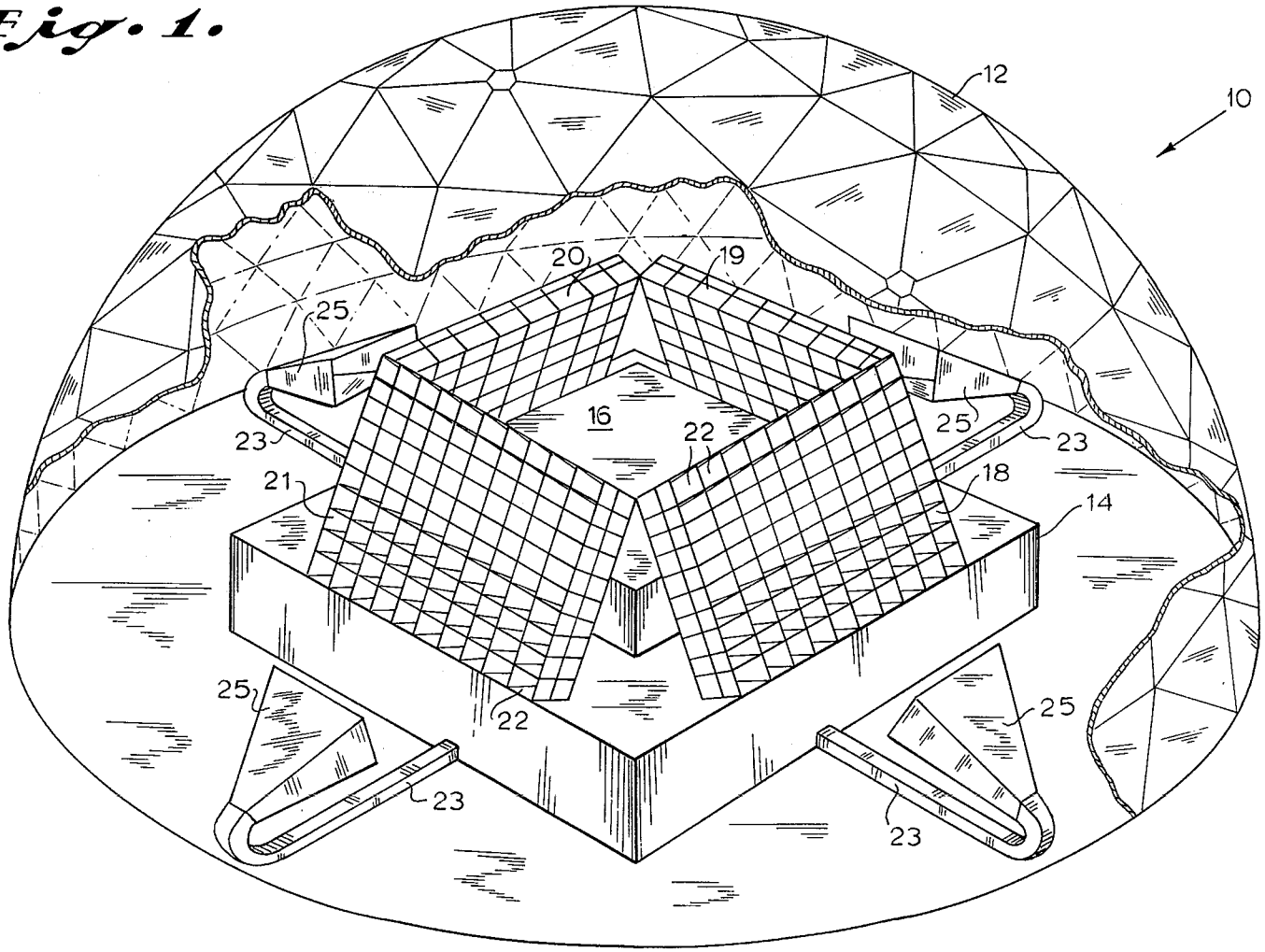

Noting FIG. 1, the system, referred to generally as 10, is shown enclosed within an inflatable radome 12, or other suitable enclosure. The system 10 includes a base 14 upon which is mounted a housing 16 which may include associated electronics and computer hardware. A plurality of arrays of elements, for example four arrays 18, 19, 20 and 21, are disposed about the periphery of the housing 16, for example, with each array facing a different quadrant. It is also preferable that each array 16-21 be disposed slightly at an acute angle with respect to the vertical axis, as is shown in FIG. 1.

Each array of elements 18–21 includes a plurality of waveguide elements 22 associated therewith, which will be described below with greater detail with reference to FIG. 2. Additionally, a rectangular waveguide 23 is provided with each array 18-21, terminating in a corresponding feed horn 25 spaced from the associated array and out of axial alignment therewith, as is noted by the dotted lines associated with the array 18 in FIG. 1. Preferably, the axis of each feed horn 25 is disposed at an angle of about 45 degrees with respect to the plane of each array.

Figure 2:
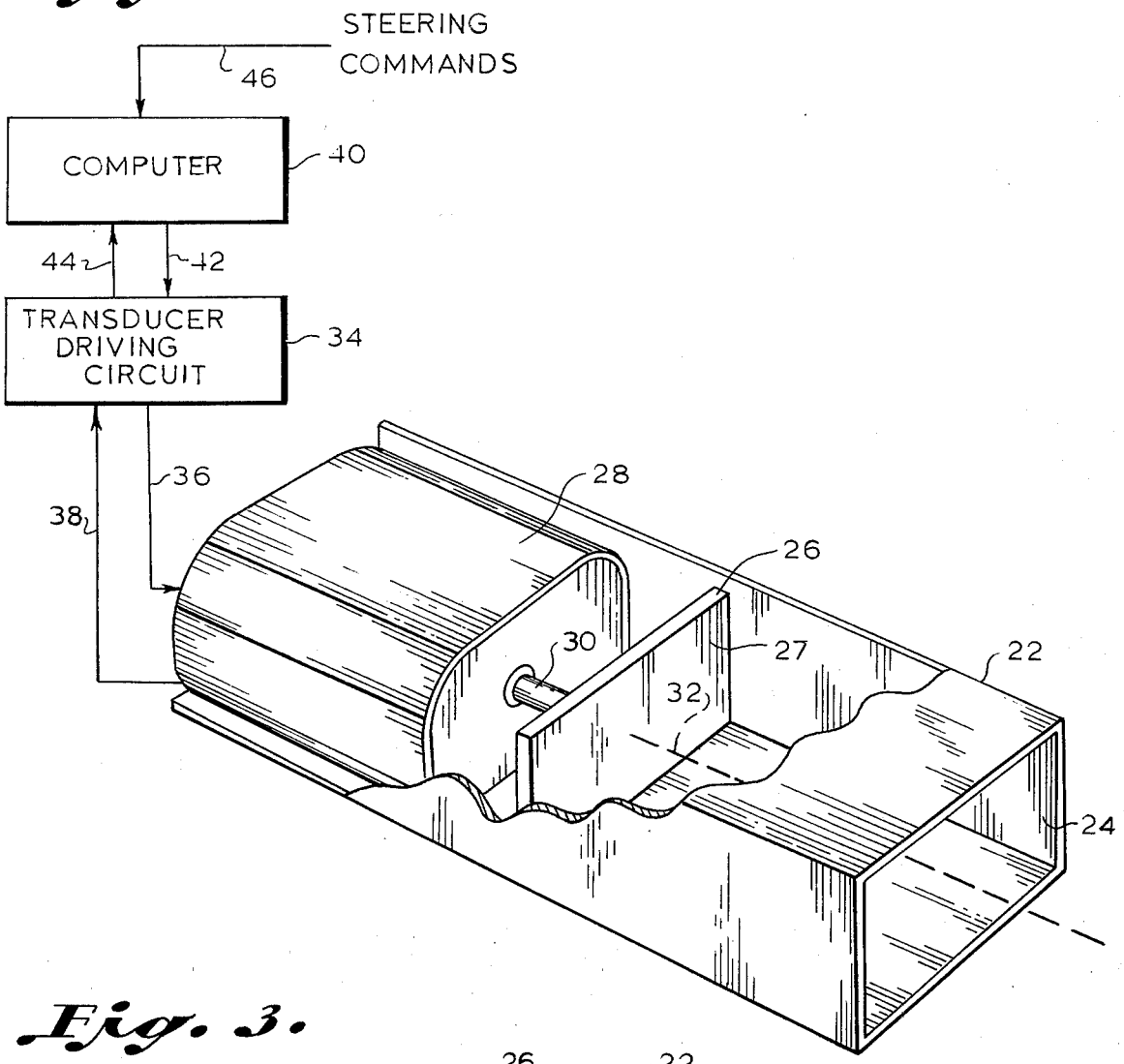

As shown in FIG. 2, each waveguide element 22 comprises a hollow rectanguloid having an opening 24 at one end thereof, and a tuning slug 26 positioned in the interior of the hollow member waveguide element 22. The tuning slug has a flat face 27, the dimensions of which are substantially identical with the cross-sectional dimensions of the hollow member 22, such that the tuning slug 26 makes a sliding fit within the hollow member. The hollow member waveguide element 22 further includes a transducer 28 having a piston 30 associated therewith and attached to the tuning slug 26, such that the transducer moves the tuning slug through the hollow member 22 by movement of the piston 30, such that the tuning slug moves in a direction substantially axial with the opening 24, as is shown by the axial dotted line 32 in FIG. 2. A variety of commercially available position transducers may be used for the transducer 28; for example, a transducer manufactured by Scharvitz Engineering Company of Camden, New Jersey, Model No. 175XS-A is suitable.

As previously described with reference to FIG. 1, the antenna system is provided with a housing 16 in which is located various computing and driving circuits necessary for electrical operation of the phased array system of the present invention. As shown in FIG. 2, these circuits may include a plurality of transducer driving circuits, for example the one transducer driving circuit 34 shown in FIG. 1 in block diagram form. The transducer driving circuit 34 is coupled to the hollow member waveguide element 22 by an electrical circuit 36, and likewise receives position signals from the transducer 28 via a feed back circuit line 38, so as to initiate braking signals to the transducer 28 as required. Additionally, a computer 40 may be provided coupled to all of the transducer driving circuits, such as the circuit 34 in FIG. 2, so as to compute the relative position of each tuning slug 26 as required to achieve a desired phase angle and beam width. The computer 40 is coupled to each transducer driving circuit by a circuit line 42, and receives positioning information via a feedback line 44, which suitably is used in conjunction with the ranging echoes received through the feed horns 25 to drive a visual display (not shown). The computer functions responsive to steering commands from an input line 46, which may be applied either manually or automatically, in a well known manner, as will be appreciated by those skilled in the art.

Operation of the phased array system, and specifically the waveguide element 22 of the present invention, will now be described with reference to FIGS. 1–4, inclusive. Initially, an automatic or manual steering command is fed to the computer 40 which determines the phase angle and beam width corresponding to that steering command. The computer then provides an input signal to the transducer driving circuit 34 associated with each waveguide element 22, instructing the associated transducer 28 to move the corresponding tuning slug 26 inwardly or outwardly, in order to properly position the tuning slug such that the position of all of the tuning slugs of the corresponding array will provide the desired phase angle and beam width.

Figure 3:
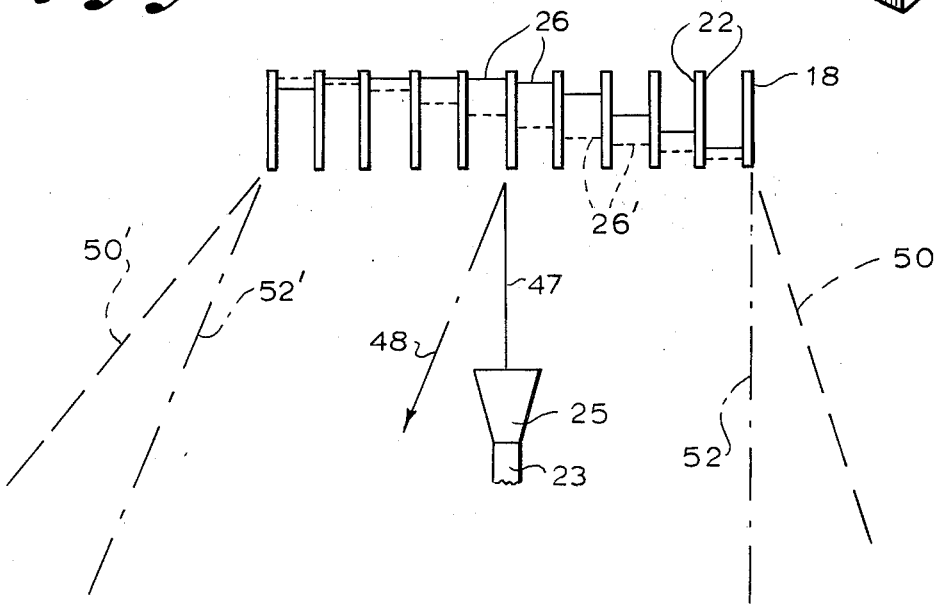
FIGS. 3 and 4 depict top plan cross-sections of an array of waveguide elements in accordance with the system of FIG. 1 and the elements shown in FIG. 2.

Noting FIG. 3, there is shown a diagrammatic cross-section of one array 18 of waveguide elements 22. For purposes of discussion, it is assumed that the steering command fed to the computer 40 in the example of FIG. 3 has instructed the transducer driving circuits 34 to position the corresponding tuning slugs 26 of the array so as to achieve a phase angle represented by a direction shown by arrow 48, with respect to the feed horn center line 47. Additionally, it is assumed that the computer 40 has instructed the transducer driving circuits 34 associated with the waveguide elements 22 of the array 18 to achieve a narrowed beam width defined by broken lines 52 and 52′. Also shown in FIG. 3 by dotted lines are a linearly staggered arrangement of tuning slugs, identified as 26′, which will, in this example, provide a beam width represented by dotted lines 50 and 50′, unless the tuning slugs are otherwise positioned.

The solid lines representing the tuning slugs 26 in FIG. 3 define a concave parabolic reflector to the energy radiated from the feed horn 25, and thus narrows the beam width, as shown by broken lines 52—52′.

Figure 4:
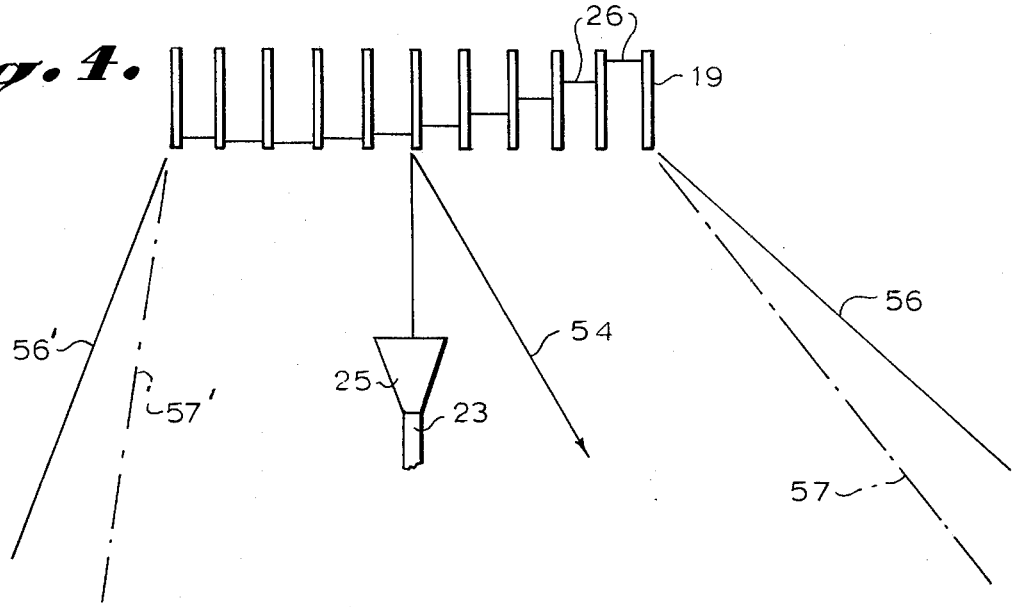

Another illustration of a non-linear alignment of the waveguide elements in accordance with the present invention is shown in FIG. 4, wherein the tuning slugs 26 are positioned so as to achieve a convex reflector with respect to the electromagnetic energy radiating from the feed horn 25. Thusly, the waveguide array 19 provides a broadened beam width defined by solid lines 56 and 56′ (with respect to a beam 57—57′ when the slugs 26 are linearly aligned), in a direction with respect to the feed horn axis as shown by the arrow 54.

Figure 5:
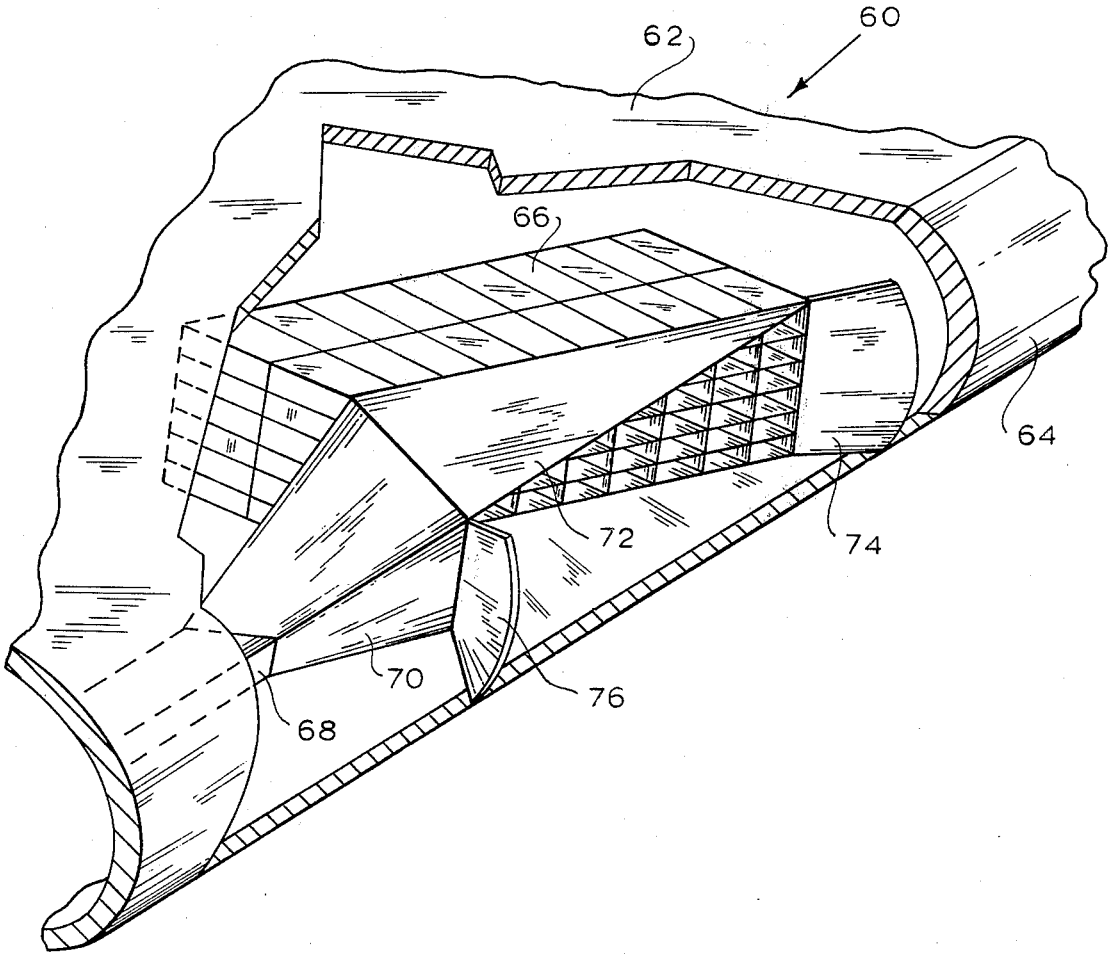
FIG. 5 illustrates a perspective view, partially cut away, of a phased array radar antenna in accordance with the present invention mounted in an on-board aircraft application.

An embodiment of the present invention in an on-board aircraft application is shown in FIG. 5. The radar system, referred to generally as 60, is positioned in a wing 62 having a leading edge 64. An array 66 of waveguide elements similar to the arrays 18–21 in FIG. 1 is positioned within the wing at an acute angle with respect to the leading edge 64. A feed horn 70 is mounted next to the array 66, but out of alignment with the waveguide elements, in the same manner as the feed horns 25 are mounted with respect to the arrays 18–21 in FIG. 1. A rectangular waveguide 68 feeds electromagnetic energy into the feed horn 70. The antenna system 60 is further provided with side lobe suppressers 74 and 76, extending outwardly from the array 66 and the feed horn 70, respectively. An upper suppressor member 72 is provided so as to concentrate the radiated energy in a substantially forward direction with respect to the plane of flight of the aircraft.

Phased array radar antennas made in accordance with the present invention are suitable for use in fixed station civilian aviation applications, as well as for on-board, single engine aircraft applications. The utilization of a mechanical tuning slug to achieve waveguide tuning for controlling phase angle and beam width substantially reduces the cost factors which have heretofore prevented the use of such systems in these applications. Further, the use of feed horns positioned out of alignment with the radiating elements reduces the number of required waveguide elements and thereby reduces the cost of the antenna system by eliminating blind spots.

Additionally, the mechanically driven tuning slug antenna of the present invention is adaptable for use with conventional radar systems of the non-phased array type.

As noted above, the antenna of the present invention is particularly suited for use on single engine aircraft, since state of the art on-board antennas can only be positioned in the nose, and are therefore unsuited for single engine aircraft.

I claim:

1. A phased array radar antenna comprising:

a two dimensional array of hollow waveguide elements, each element having opposed ends with an opening at one of said ends;

a plurality of tuning slugs, each tuning slug positioned in one of said waveguide elements and having a substantially flat face in a direction toward said opening at said one end;

a plurality of transducers, each transducer positioned adjacent the other of said ends of one of said waveguide elements;

a piston coupled between each transducer and the corresponding one of said tuning slugs such that said tuning slug may be moved through the corresponding one of said waveguide elements responsive to energization of said transducer; and means spaced from said one end of all of said waveguide elements for radiating electromagnetic energy into said elements whereby energy is reflected therefrom in a direction determined by the position of said tuning slugs.

2. A phased array radar antenna system in accordance with claim 1 wherein said transducer is coupled to said piston for moving the corresponding tuning slug responsive to an electrical input thereto.

3. A phased array radar antenna system as recited in Claim 2 further comprising circuit means for generating said electrical input into said transducer, said generating means comprising means for computing the position of each tuning slug face so as to achieve a desired beam direction and width.

4. A phased array radar antenna system as recited in Claim 3 further comprising means for providing a feedback to said circuit means for braking said transducer.

5. A phased array radar antenna system in accordance with claim 1 wherein said radiating means comprises a feed horn out of axial alignment with said hollow elements.

6. A phased array radar antenna system as recited in claim 5 wherein said feed horn has an axis disposed approximately 45 degrees with respect to the axes of said hollow elements.

7. A phased array radar antenna system in accordance with claim 1 wherein said array of hollow elements comprises a plurality of rectanguloids, each having a central axis substantially parallel with the central axes of the other of said hollow elements and an acute angle with respect to said radiating means.

8. A phased array radar antenna system as recited in claim 7 wherein said radiating means is disposed out of the plane of all of said axes.

* * * * *